US012091064B2

(12) United States Patent
Keener

(10) Patent No.: US 12,091,064 B2
(45) Date of Patent: Sep. 17, 2024

(54) MODULAR CRASH ENERGY MANAGEMENT SYSTEMS FOR CAR COUPLING SYSTEMS OF RAIL CARS

(71) Applicant: Amsted Rail Company, Inc., Chicago, IL (US)

(72) Inventor: Scott A. Keener, Harrisburg, PA (US)

(73) Assignee: Amsted Rail Company, Inc., Chicago, IL (US)

( * ) Notice: Subject to any disclaimer, the term of this patent is extended or adjusted under 35 U.S.C. 154(b) by 822 days.

(21) Appl. No.: 17/183,404

(22) Filed: Feb. 24, 2021

(65) Prior Publication Data

US 2022/0242463 A1 Aug. 4, 2022

Related U.S. Application Data

(63) Continuation-in-part of application No. 17/161,843, filed on Jan. 29, 2021.

(51) Int. Cl.
*B61G 11/16* (2006.01)
*B61G 3/04* (2006.01)

(52) U.S. Cl.
CPC ..... *B61G 11/16* (2013.01); *B61G 3/04* (2013.01)

(58) Field of Classification Search
CPC ..... B61G 11/16
See application file for complete search history.

(56) References Cited

U.S. PATENT DOCUMENTS 2,260,532 A * 10/1941 Lindeman ..... B61G 9/14 267/293
6,681,943 B2 * 1/2004 Barker ..... B61G 9/06 213/46 R
7,708,157 B2 5/2010 Kemper
8,672,151 B2 * 3/2014 Sprainis ..... B61G 9/06 213/32 C
9,663,122 B2 * 5/2017 Watts ..... B61G 11/16
9,868,453 B2 * 1/2018 Johnson ..... B61G 11/02
(Continued)

FOREIGN PATENT DOCUMENTS

CA 2977145 A1 * 3/2018 ..... B61G 9/04
DE 102016205981 10/2017
(Continued)

OTHER PUBLICATIONS

Notification of Transmittal of the International Search Report and the Written Opinion of the Internal Searching Authority, or the Declaration for PCT/US2022/037665, dated Nov. 21, 2022.
(Continued)

*Primary Examiner* — Scott A Browne
(74) *Attorney, Agent, or Firm* — Joseph M. Butscher; The Small Patent Law Group LLC

(57) ABSTRACT

A car coupling system for a rail vehicle includes a first crash energy management system disposed within a draft sill. The first crash energy management system includes a first end plate, a second end plate, and a first central tube disposed between the first end plate and the second end plate. A second crash energy management system is also disposed within the draft sill. The second crash energy management system includes a third end plate, a fourth end plate, and a second central tube disposed between the third end plate and the fourth end plate.

20 Claims, 7 Drawing Sheets

(56) References Cited

U.S. PATENT DOCUMENTS

| | | | | |
|---|---|---|---|---|
| 2009/0065462 | A1* | 3/2009 | Gansweidt | E02B 3/26 213/1 A |
| 2017/0158211 | A1* | 6/2017 | Bonney | B61G 9/04 |
| 2020/0385033 | A1* | 12/2020 | Schoedl | B61G 3/04 |

FOREIGN PATENT DOCUMENTS

| | | | | |
|---|---|---|---|---|
| EP | 1955918 | | 8/2008 | |
| EP | 2687417 | A1 * | 1/2014 | B61G 11/06 |
| WO | WO 2005/023618 | | 3/2005 | |
| WO | WO 2012/067526 | | 5/2012 | |
| WO | WO 2019/240660 | | 12/2019 | |

OTHER PUBLICATIONS

International Preliminary Report on Patentability for PCT/US2021/059824, sent Aug. 10, 2023.

* cited by examiner

MODULAR CRASH ENERGY MANAGEMENT SYSTEMS FOR CAR COUPLING SYSTEMS OF RAIL CARS

RELATED APPLICATIONS

This application is a continuation-in-part of U.S. patent application Ser. No. 17/161,843, filed Jan. 29, 2021, which is hereby incorporated by reference in its entirety.

FIELD OF THE DISCLOSURE

Embodiments of the present disclosure generally relate to coupling systems for rail vehicles, such as rail cars, and more particularly to car coupling systems having crash energy management systems.

BACKGROUND OF THE DISCLOSURE

Rail vehicles travel along railways, which have tracks that include rails. A rail vehicle includes one or more truck assemblies that support one or more car bodies.

When rail cars impact each other, longitudinal forces are exerted into car coupling systems thereof. If a maximum force limit is desired, energy attenuation devices can be used within the car coupling systems. A draft gear is such a device, but is usually limited with respect to forces that can be attenuated. However, when excessive forces are exerted into the car coupling system, there is a potential for damage to the car coupling systems.

SUMMARY OF THE DISCLOSURE

A need exists for a system and a method for attenuating energy exerted into a car coupling system. Further, a need exists for a system and a method that absorb energy that exceeds a predetermined force threshold. Moreover, a need exists for an efficient, effective, and low cost system for absorbing and attenuating such energy.

With those needs in mind, certain embodiments of the present disclosure provide a car coupling system for a rail vehicle. The car coupling system includes a draft sill, and a crash energy management system disposed within the draft sill. The crash energy management system includes a first end plate, a second end plate, and a central tube disposed between the first end plate and the second end plate. The central tube is configured to deform in response to a force exerted into the car coupling system that exceeds a predetermined force threshold. Deformation of the central tube attenuates at least a portion of the force.

In at least one embodiment, a coupler extends outwardly from a first end of the draft sill. Further, a first stop is within the draft sill. A draft gear having a yoke is also within the draft sill. The coupler connects to the draft gear. Additionally, a second stop is within the draft sill. In at least one embodiment, the crash energy management system is disposed between the draft gear and the second stop.

As an example, the crash energy management system is formed of steel.

In at least one embodiment, the central tube has a length, an outer diameter, and a wall thickness. A ratio of the length to the outer diameter is 2:1, and a ratio of the outer diameter to the wall thickness is 8:1.

In at least one embodiment, the crash energy management system further includes a supplemental tube within an internal chamber of the central tube. As an example, the supplemental tube has a length, an outer diameter, and a wall thickness. A ratio of the length to the outer diameter is 2:1, and a ratio of the outer diameter to the wall thickness is 8:1. In at least one embodiment, the supplemental tube is coaxial with the central tube.

In at least one embodiment, the crash energy management system further include one or more supplemental tubes outside of the central tube.

Certain embodiments of the present disclosure provide a method of forming a car coupling system for a rail vehicle. The method includes disposing a crash energy management system within a draft sill, as described herein.

Certain embodiments of the present disclosure provide a car coupling system for a rail vehicle. The car coupling system includes a draft sill. A first crash energy management system is disposed within the draft sill. The first crash energy management system includes a first end plate, a second end plate, and a first central tube disposed between the first end plate and the second end plate. The first central tube is configured to deform in response to a first force exerted into the car coupling system that exceeds a first predetermined force threshold. Deformation of the first central tube attenuates at least a portion of the first force. A second crash energy management system is also disposed within the draft sill. The second crash energy management system includes a third end plate, a fourth end plate, and a second central tube disposed between the third end plate and the fourth end plate. The second central tube is configured to deform in response to a second force exerted into the car coupling system that exceeds a second predetermined force threshold. Deformation of the second central tube attenuates at least a portion of the second force.

In at least one embodiment, the first force equals the second force, and the first predetermined force threshold equals the second predetermined force threshold. In at least one other embodiment, the first force differs from the second force, and the first predetermined forced threshold differs from the second predetermined force threshold.

In at least one embodiment, one or both of the first crash energy management system or the second crash energy management system is interchangeable with a third crash energy management system.

In at least one embodiment, the first crash energy management system is configured the same as the second crash energy management system. In at least one other embodiment, the first crash energy management system is configured differently than the second crash energy management system.

In at least one embodiment, the first central tube differs from the second central tube with respect to one or more of length, diameter, or wall thickness.

In at least one embodiment, one of the first crash energy management system or the second crash energy management system includes one or more supplemental tubes.

In at least one embodiment, the first crash energy management system includes one or more first supplemental tubes, and the second crash energy system includes one or more second supplemental tubes. As an example, the one or more first supplemental tubes differ from the one or more second supplemental tubes with respect to one or more of length, diameter, or wall thickness.

In at least one embodiment, the third end plate directly abuts the second end plate. In at least one embodiment, the second end plate and the third end plate are integrally formed together as a common intermediate plate.

In at least one embodiment, the car coupling system further includes a coupler extending outwardly from a first end of the draft sill, a first stop within the draft sill, a draft gear having a yoke within the draft sill, wherein the coupler connects to the draft gear, and a second stop within the draft sill. In at least one example, the first crash energy management system and the second crash energy management system are disposed between the draft gear and the second stop.

In at least one embodiment, each of the first central tube and the second central tube has a length, an outer diameter, and a wall thickness. A ratio of the length to the outer diameter is 2:1, and a ratio of the outer diameter to the wall thickness is 8:1.

Certain embodiments of the present disclosure provide a method of forming a car coupling system for a rail vehicle. The method includes disposing a first crash energy management system within a draft sill, and disposing a second crash energy management system within the draft sill.

DETAILED DESCRIPTION OF THE DISCLOSURE

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Embodiments of the present disclosure provide a crash energy management system for a coupling system of a rail vehicle. The crash energy management system can be used in series with a draft gear to attenuate energy above and beyond that which a typical draft gear is configured to handle, thereby keeping a peak force below a desired limit. In at least one embodiment, the crash energy management system includes a canister with flanges at each end. When force that exceeds a predetermined force threshold is exerted into the coupling system, the crash energy management system plastically deforms (such as via concertina buckling), and strokes a prescribed distance while managing the energy and force during the impact. In at least one embodiment, the crash energy management system is akin to a mechanical fuse. Once deformed, the crash energy management system may be unable to return to a non-deformed state. As such, the crash energy management system may not be reused after deformation.

Figure 1:
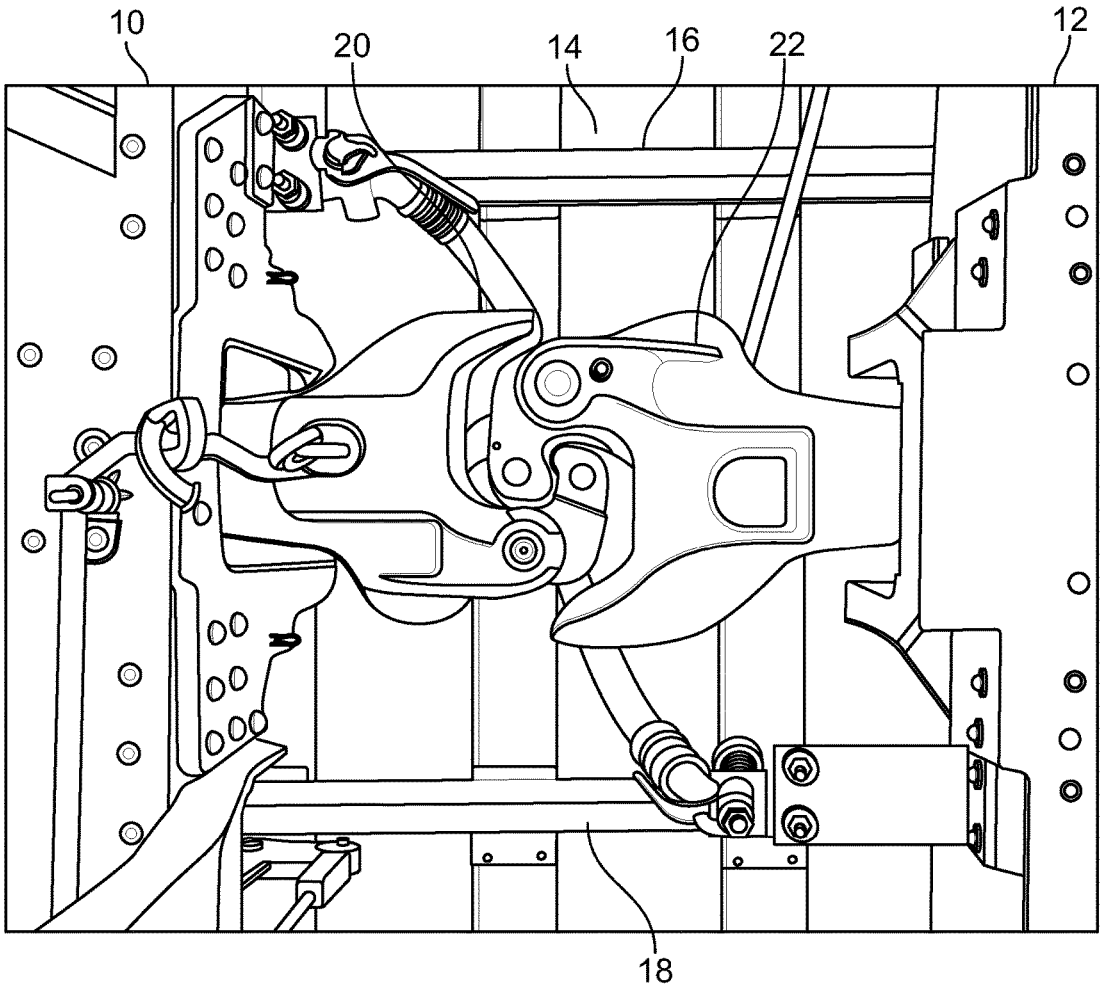
FIG. 1 illustrates a top view of a first rail car coupled to a second rail car.

FIG. 1 illustrates a top view of a first rail car 10 coupled to a second rail car 12. The first rail car 10 and the second rail car 12 are configured to travel along a track 14 having rails 16 and 18. A coupler 20 of the first rail car 10 connects to a coupler 22 of the second rail car 12.

Figure 2:
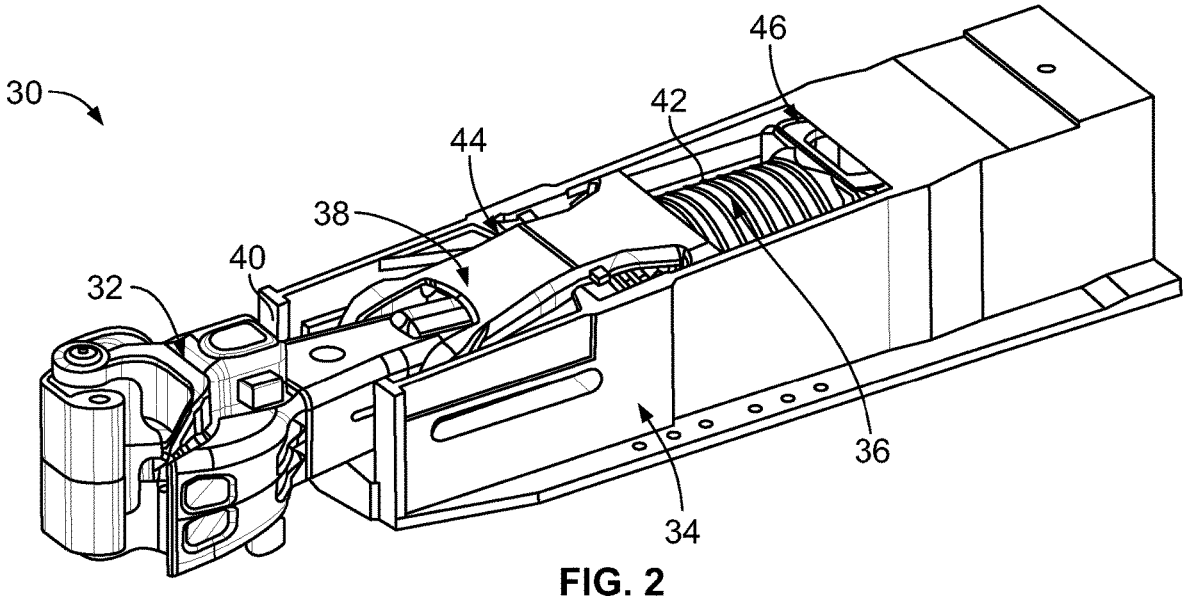
FIG. 2 illustrates a perspective top view of a car coupling system.

FIG. 2 illustrates a perspective top view of a car coupling system 30. The first rail car 10 and the second rail car 12 include a car coupling system 30. The car coupling system 30 includes a coupler 32 (such as the coupler 20 or the coupler 22 shown in FIG. 1), a draft sill 34, and a draft gear 36 with yoke 38. The coupler 32 is supported at a first end 40 by the draft sill 34 and at an opposite second end 42 by the draft gear 36 or cushion unit with the yoke 38. The draft gear 36 or cushion unit is constrained within the draft sill 34 by a pair of front stops 44 and a pair of rear stops 46.

Figure 3:
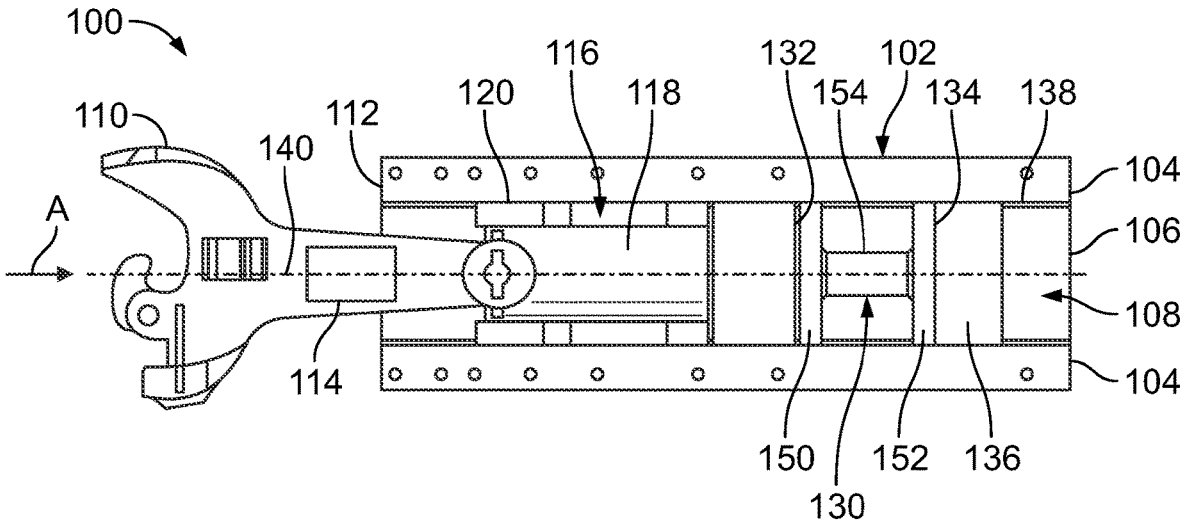
FIG. 3 illustrates a bottom view of a car coupling system, according to an embodiment of the present disclosure.
Figure 4:
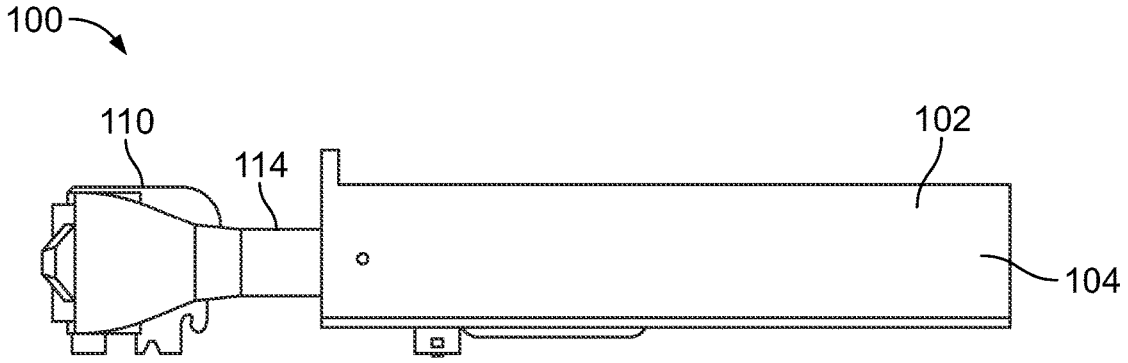
FIG. 4 illustrates a lateral view of the car coupling system of FIG. 3.

FIG. 3 illustrates a bottom view of a car coupling system 100, according to an embodiment of the present disclosure. FIG. 4 illustrates a lateral view of the car coupling system 100 of FIG. 3. Referring to FIGS. 3 and 4, the car coupling system 100 includes a draft sill 102 including lateral walls 104 connected to a top wall 106. A chamber 108 is defined between the lateral walls 104 and the top wall 106. A carrier plate secures to the lateral walls 104 opposite from the top wall 106. For the sake of clarity, the carrier plate is not shown.

A coupler 110 extends outwardly from a first end 112 (for example, a fore end) of the draft sill 102. A shank 114 of the coupler 110 extends into the chamber 108 and connects to a draft gear 116. The draft gear 116 includes a yoke 118. A first stop 120 is secured to internal portions of the draft sill 102. At least a portion of the draft gear 116 is disposed behind (that is, further from the first end 112) the first stop 120.

A crash energy management system 130 is disposed within the draft sill 102 between an aft end 132 of the draft gear 116 and a fore end 134 of a second stop 136, which is proximate to a second end 138 (for example, an aft end) of the draft sill 102. The crash energy management system 130 is longitudinally aligned with the draft gear 116. For example, the crash energy management system 130 and the draft gear 116 are longitudinally aligned along a central longitudinal axis 140 of the car coupling system 100.

In at least one embodiment, the crash energy management system 130 is aligned in series between the draft gear 116 and the second stop 136. As shown, the crash energy management system 130 is disposed behind the draft gear 116 and in front of the second stop 136.

As described herein, the crash energy management system 130 provides a mechanical fuse that is configured to deform when a force exceeding a predetermined force threshold is exerted into the car coupling system 100 in the direction of arrow A, for example. By deforming in response to the force in the direction of arrow A that exceeds a predetermined force threshold, the crash energy management system 130 attenuates and absorbs at least a portion of the force, thereby ensuring that other components of the car coupling system 100 and associated rail car are not subjected to the peak force. In this manner, the crash energy management system 130 prevents or otherwise reduces potential damage to the car coupling system 100 and the rail car.

Figure 5:
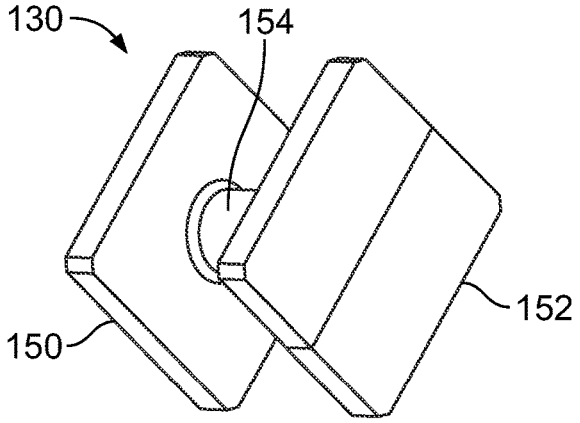
FIG. 5 illustrates a perspective view of a crash energy management system, according to an embodiment of the present disclosure.

FIG. 5 illustrates a perspective view of the crash energy management system 130, according to an embodiment of the present disclosure. In at least one embodiment, the crash energy management system 130 is formed of a metal, such as steel aluminum, or the like. As another example, the crash energy management system 130 can be formed of a plastic, such as resin. As another example, the crash energy management system 130 can be formed of metal and plastic.

The crash energy management system 130 includes a first end plate 150 connected to a second end plate 152 by a central tube 154 (for example, a canister). Referring to FIGS. 3 and 5, the first end plate 150 abuts against the aft end 132 of the draft gear 116, and the second end plate 152 abuts against the fore end 134 of the second stop 136. The first end plate 150 may be secured to the aft end 132 through one or more fasteners, adhesives, and/or the like. Similarly, the second end plate 152 may be secured to the fore end 134 through one or more fasteners, adhesives, and/or the like. In at least one other embodiment, the first end plate 150 and the second end plate 152 are not fastened or otherwise fixed to the aft end 132 and the fore end 134, respectively, with fasteners and/or adhesives.

Figure 6:
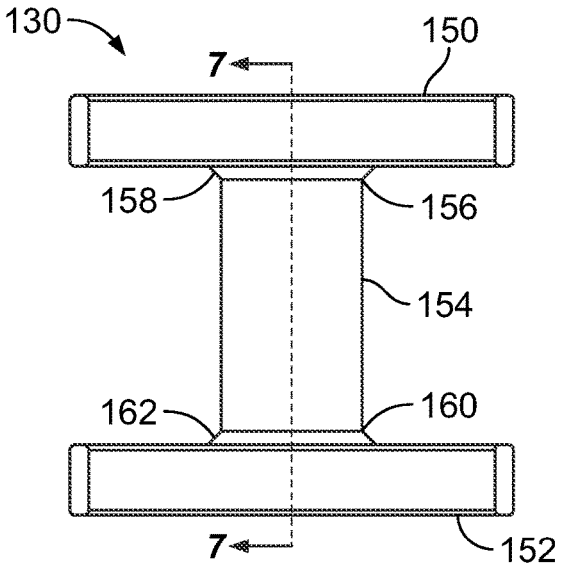
FIG. 6 illustrates a lateral view of the crash energy management system of FIG. 5.

FIG. 6 illustrates a lateral view of the crash energy management system 100 of FIG. 5. In at least one embodiment, the central tube 154 has a circular axial cross-section. A first end 156 of the central tube 154 can be secured to the first end plate 150 at a weld line 158. Similarly, a second end 160 of the central tube 154 can be secured to the second end plate 152 at a weld line 162.

Figure 7:
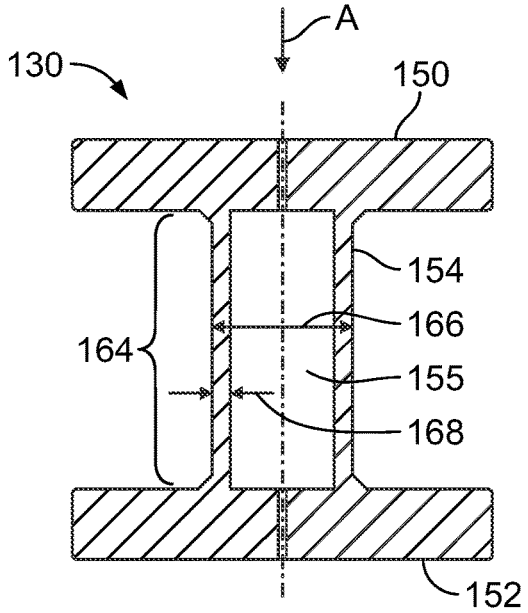
FIG. 7 illustrates a cross-sectional view of the crash energy management system through line 7-7 of FIG. 6.

FIG. 7 illustrates a cross-sectional view of the crash energy management system 130 through line 7-7 of FIG. 6. In at least one embodiment, the central tube 154 is hollow, having an internal chamber 155. The central tube 154 includes a length 164, an outer diameter 166, and a wall thickness 168. In order to achieve concertina buckling upon deformation (in response to experiencing force in the direction of arrow A), the ratio of the length 164 to outer diameter 166 is 2:1. For example, the length 164 can be 8 inches, and the outer diameter 166 is 4 inches. Optionally, the length 164 can be greater or less than 8 inches, and the outer diameter 166 can be greater or less than 4 inches. For example, the length 164 can be 4 inches, and the outer diameter 166 can be 2 inches.

Further, in order to achieve concertina buckling, the ratio of the outer diameter 166 to the wall thickness 168 is 8:1. For example, the outer diameter is 4 inches, and the wall thickness 168 is 0.5 inches. Optionally, the outer diameter 166 can be greater or less than 4 inches, and the wall thickness 168 can be greater or less than 0.5 inch. For example, the outer diameter 166 can be 8 inches, and the wall thickness 168 can be 1 inch.

Plastic deformation of the central tube 154 via concertina buckling is desirable as it exhibits an ideal force travel curve. As noted, in order to ensure concertina buckling, the ratio of the length 164 to the outer diameter 166 is 2:1, while the ratio of the outer diameter 166 to the wall thickness 168 is 8:1. Alternatively, the outer tube 154 can be sized and shaped differently so as not to provide concertina buckling.

Figure 8:
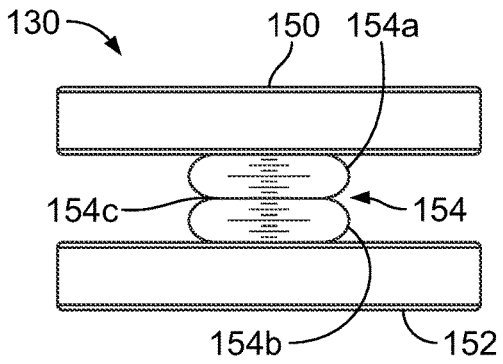
FIG. 8 illustrates a lateral view of the crash energy management system in a deformed state, according to an embodiment of the present disclosure.

FIG. 8 illustrates a lateral view of the crash energy management system 130 in a deformed state, according to an embodiment of the present disclosure. Referring to FIGS. 3-8, when a force that exceeds a predetermined force threshold is exerted into the car coupling system 100 in the direction of arrow A, the central tube 154 deforms, thereby absorbing and attenuating the energy of the force. As shown in FIG. 8, the deformation occurs as concertina buckling, in which the central tube 154 deforms into a first axially compressed and radially expanded bulge 154*a* separated from a second axially compressed and radially expanded bulge 154*b* by an intermediate seam 154*c*.

Referring to FIGS. 1-8, the car coupling system 100 for a rail vehicle includes the draft sill 102, and the crash energy management system 130 disposed within the draft sill 102. The crash energy management system 130 includes the first end plate 150, the second end plate 152, and the central tube 154 disposed between the first end plate 150 and the second end plate 152. The central tube 154 is configured to deform in response to a force exerted into the car coupling system 100 that exceeds a predetermined force threshold. Deformation of the central tube 154 attenuates at least a portion of the force.

Figure 9:
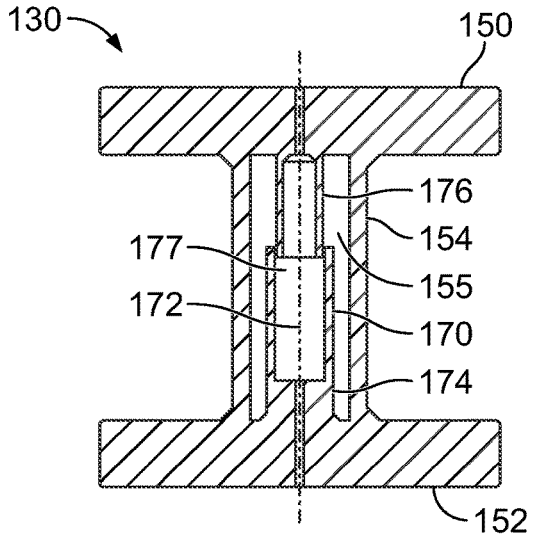
FIG. 9 illustrates a cross-sectional view of the crash energy management system through line 7-7 of FIG. 6, according to an embodiment of the present disclosure.

FIG. 9 illustrates a cross-sectional view of the crash energy management system 130 through line 7-7 of FIG. 6, according to an embodiment of the present disclosure. Depending on the amount of energy attenuation desired, a supplemental tube 170 can be disposed within the internal chamber 155 of the central tube 154. In at least one embodiment, the supplemental tube 170 is coaxial with the central tube 154. For example, the central tube 154 and the supplemental tube 170 are coaxial with a central longitudinal axis 172 of the crash energy management system 130.

In at least one embodiment, the supplemental tube 170 is a half scale of the central tube 154. In order to achieve concertina buckling upon deformation, the central tube 154 and the supplemental tube 170 are both sided and shaped to have a length to outer diameter ratio of 2:1, and an outer diameter to wall thickness ratio of 8:1. As a non-limiting example, the central tube 150 has a length of 8 inches, an outer diameter of 4 inches, and a wall thickness of 0.5 inches, while the supplemental tube 170 has a length of 4 inches, an outer diameter of 2 inches, and a wall thickness of 0.25 inches.

In at least one embodiment, the supplemental tube 170 extends from a pedestal 174 that extends from the second end plate 152. The supplemental tube 170 connects to a guide tube 176 that extends from the first end plate 150 into a central chamber 177 of the supplemental tube 170. The guide tube 176 ensures that the supplemental tube 170 remains longitudinally aligned as the central tube 154 deforms.

During deformation, as the central tube 154 deforms, the supplemental tube 170 is urged toward the first end plate 150 and is aligned by the guide tube 176. As the supplemental tube 170 abuts against the first end plate 150, the supplemental tube 170 deforms similar to the central tube 154, as described herein.

The addition of the supplemental tube 170 provides additional deformation and energy attenuation. Deformation of the supplemental tube 170 provides additional concertina buckling, for example, that provides a smoother and more desirable force travel curve.

Figure 10:
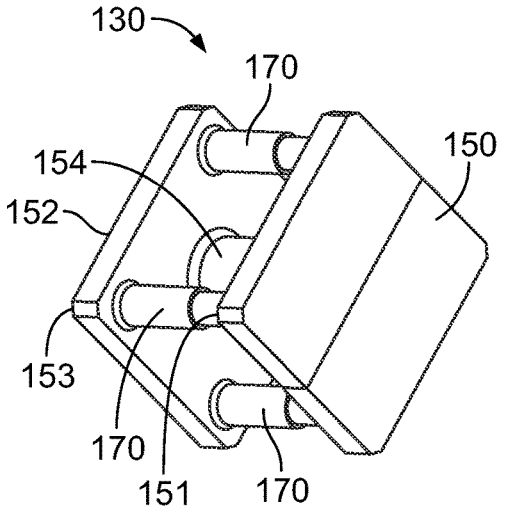
FIG. 10 illustrates a perspective view of a crash energy management system, according to an embodiment of the present disclosure.
Figure 11:
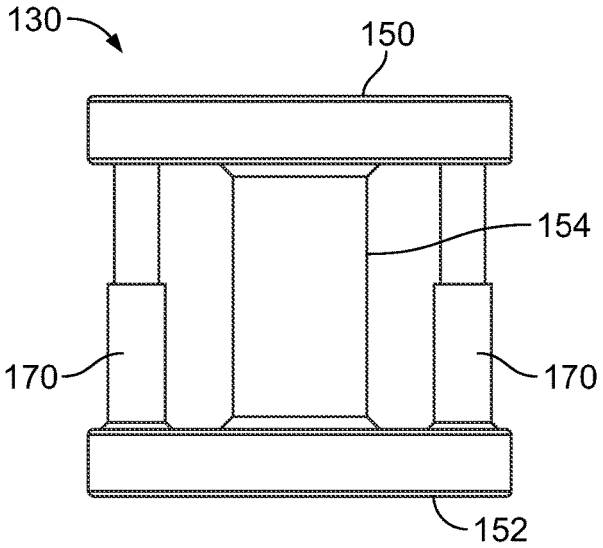
FIG. 11 illustrates a lateral view of the crash energy management system of FIG. 10.

FIG. 10 illustrates a perspective view of the crash energy management system 130, according to an embodiment of the present disclosure. FIG. 11 illustrates a lateral view of the crash energy management system 130 of FIG. 10. In this embodiment, depending on the amount of energy attenuation desired, supplemental tubes 170, as described with respect to FIG. 9, can be disposed at corners of the crash energy management system 130. For example, an exterior supplemental tube 170 can be disposed between a first corner 151 of the first end plate 150, and a first corner 153 of the second end plate 152. Each supplemental tube 170 is parallel to the central tube 154. As shown, the crash energy management system 130 can include four supplemental tubes 170.

The supplemental tubes 170 are exterior in that each is not disposed within the central tube 154. The central tube 154 may also include a supplemental tube 170 disposed therein, as described with respect to FIG. 9. The crash energy management system 130 can include more or less supplemental tubes 170 than shown. For example, the crash energy management system 130 can include two supplemental tubes 170 in addition to the central tube 154.

Referring to FIGS. 9-11, in at least one embodiment, the supplemental tubes 170 are sized, shaped, and configured to activate (for example, initiate deformation) such that the ensuring deformation contributes to help smooth an overall force vs. travel curve. The main, central tube 154 may deform and cause one or more aberrations (for example, dips) in the curve. The supplemental tubes 170 are configured to fill in such aberrations.

Figure 12:
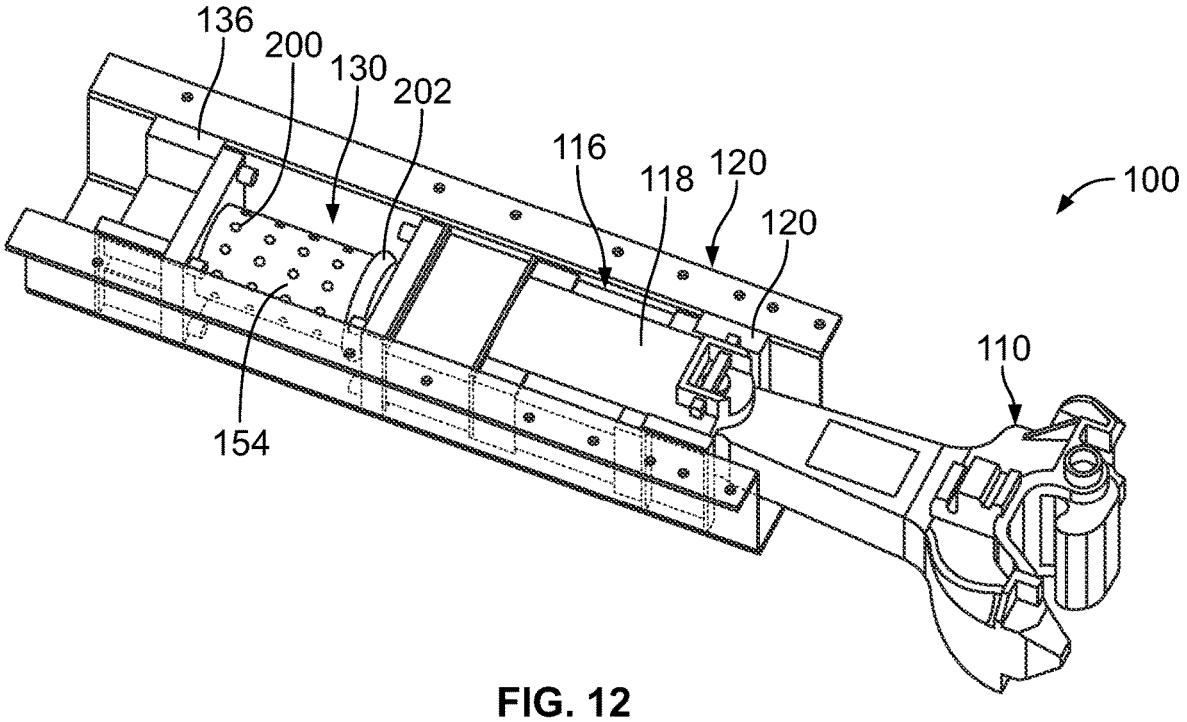
FIG. 12 illustrates a perspective bottom view of a car coupling system, according to an embodiment of the present disclosure.

FIG. 12 illustrates a perspective bottom view of the car coupling system 100, according to an embodiment of the present disclosure. As shown, the crash energy management system 130 can include one or more indentations, recesses, or channels 200 formed therein or therethrough, such as through the central tube 154. Further, the crash energy management system 130 can include one or more radial rims 202 radially extending from an outer surface of the central tube 154.

Figure 13:
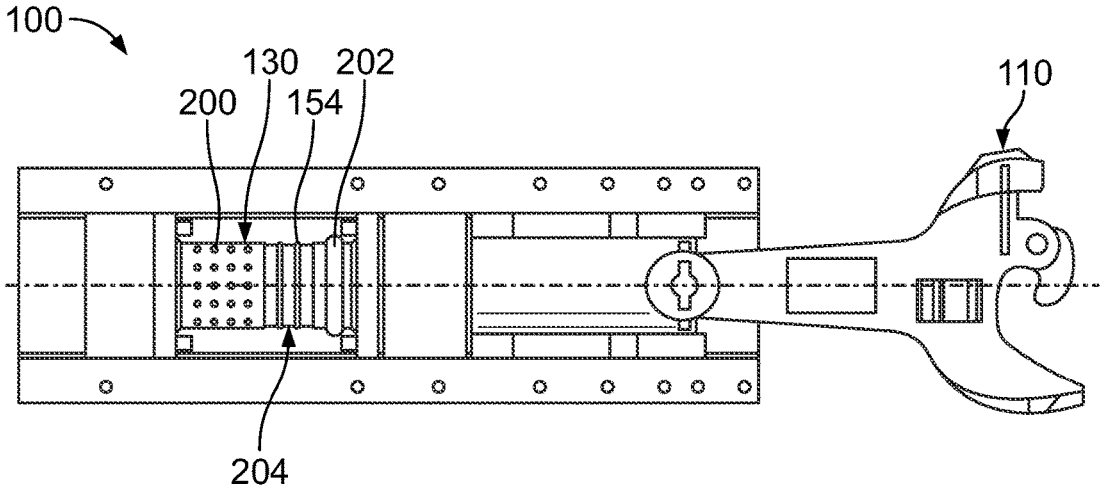
FIG. 13 illustrates a bottom view of a car coupling system, according to an embodiment of the present disclosure.

FIG. 13 illustrates a bottom view of a car coupling system 100, according to an embodiment of the present disclosure. The crash energy management system 130 can include one or more annular recesses 204 formed into the central tube 154.

Figure 14:
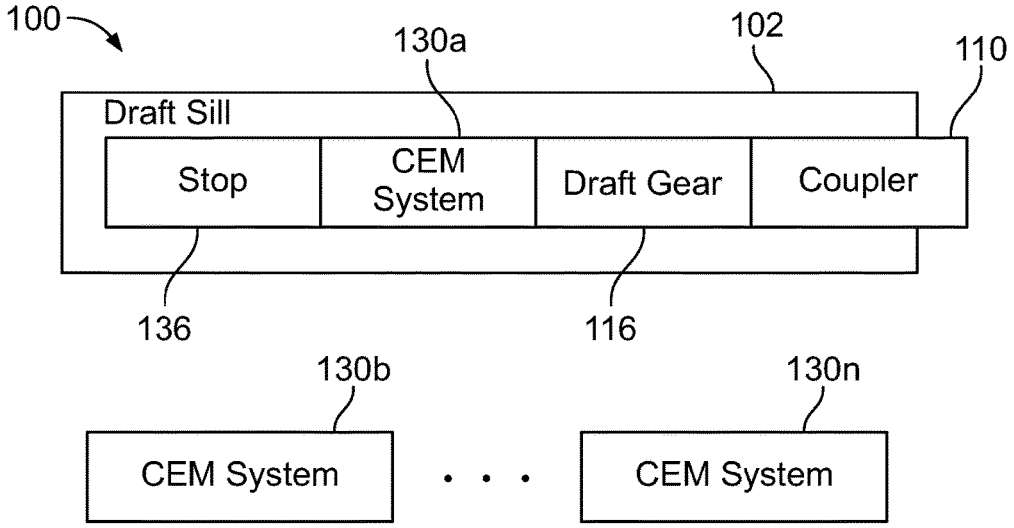
FIG. 14 illustrates a schematic block diagram of a car coupling system, according to an embodiment of the present disclosure.

FIG. 14 illustrates a schematic block diagram of a car coupling system 100, according to an embodiment of the present disclosure. Referring to FIGS. 3-14, in at least one embodiment, the car coupling system 100 is a modular car coupling system in which different crash energy management systems can be interchangeably disposed within the draft sill 102.

As shown and described, the crash energy management system 130*a*, such as any of those described herein, is disposed between the draft gear 116 and the second stop 136. The crash energy management system 130*a* can be removed from the draft sill 102 and replaced with any of a number of different crash energy management systems 130*b*, . . . or 130*n*. The crash energy management system 130*a* can be replaced with a different crash energy management system 130*b*, . . . or 130*n* that may be configured the same as the crash energy management system 130*a*. For example, the crash energy management system 130*a* may need to be replaced for maintenance. As another example, the crash energy management system 130*a* may be replaced with a different crash energy management system 130*b*, . . . or 130*n* that is configured differently than the crash energy management system 130*a*. In particular, the crash energy management system 130*b*, . . . or 130*n* may be sized and shaped differently than the crash energy management system 130*a*.

The replacement crash energy management system 130*b*, . . . or 130*n* may differ with respect to the crash energy management system 130*a* with respect to one or more of the respective central tubes 154 having different lengths, different diameters, and/or different wall thicknesses. For example, the crash energy management system 130*a* includes a central tube 154 having a first length, a first diameter, and a first wall thickness, while a replacement crash energy management system, such as the crash energy management system 130*b* includes a central tube 154 having a second length, a second diameter, and a second wall thickness. The first length may differ from the second length. The first diameter may differ from the second diameter. The first wall thickness may differ from the second wall thickness.

As another example, the crash energy management system 130*a* may have one or more supplemental tubes 170, while the crash energy management system 130*b* may not have any supplemental tubes 170, or vice versa. As another example, both the crash energy management systems 130*a* and 130*b* may have one or more supplemental tubes 170, but such may differ in one or more of length, diameter, and/or wall thickness. As another example, the crash energy management system 130*a* may have one or more supplemental tubes 170 outside of central tube 154, while the crash energy management system 130*b* does not, or vice versa. As another example, both the crash energy management system 130*a* and 130*b* may have supplemental tubes 170 outside of the central tube 154, but the respective supplemental tubes 170 may differ in or more of length, diameter, and/or wall thickness.

In at least one embodiment, the supplemental tubes 170 of each and/or separate crash energy management systems 130 can be uniquely staggered in their initiation for fine tuning of the force travel curve. For example, a crash energy management system 130 can include multiple supplemental tubes 170, as described herein, with at least two of the supplemental tubes 170 being configured to deform in response to different magnitudes of force. At least two of the supplemental tubes 170 within one crash energy management system 130 can be differently configured. As another example, supplemental tubes 170 of different crash energy management systems 130, whether or not within a common draft sill 102, can be configured to deform to different magnitudes of force.

Various different crash energy management systems 130*a*-130*n* may be interchangeably disposed within the draft sill 102, as desired. Different crash energy management system 130*a*-130*n* may be used based on a desired amount of crash energy management for a particular application. Further, the crash energy management system 130*a*-130*n* may be disposed at different locations within the draft sill 102, depending on a desired area of crash energy management. For example, the crash energy management system 130*a*-130*n* can be disposed aft of the second stop 136, between the coupler 110 and the draft gear 116, and/or the like. As another example, multiple crash energy management systems 130*a*-130*n* may be disposed within the draft sill 102. For example, the crash energy management system 130*a* can be disposed between the draft gear 116 and the second stop 136, while an additional crash energy management system 130*b*, . . . or 130*n* can also be disposed within the draft sill 102. The additional crash energy management system 130*b*, . . . or 130*n* can be separated from the crash energy management system 130*a*. As another example, the additional crash energy management system 130*b*, . . . or 130*n* can be directly coupled to the crash energy management system 130*a*. For example, the crash energy management system 130*b* can abut into an aft end of the crash energy management system 130*a*. As such, the crash energy management system 130*b* can be disposed between the crash energy management system 130*a* and the second stop 136.

In at least one embodiment, two or more crash energy management systems 130*a*-130*n* can be disposed within the draft sill 102. For example, three crash energy management systems 130 can be disposed within the draft sill 102. The crash energy management systems 130 can be directly linked together, such as between the draft gear 116 and the second stop 136, or at least two of the crash energy management systems 130 can be separated from one another by a component other than another crash energy management system 130.

As described herein, the crash energy management systems 130*a*-130*n* provide mechanical fuses that are configured to deform when a force exceeding a predetermined force threshold is exerted into the car coupling system 100. By deforming in response to the force that exceeds a predetermined force threshold, the crash energy management systems 130*a*-130*n* attenuate and absorb at least a portion of the force, thereby ensuring that other components of the car coupling system 100 and associated rail car are not subjected to the peak force. In this manner, the crash energy management systems 130 prevent or otherwise reduce potential damage to the car coupling system 100 and the rail car.

Figure 15:
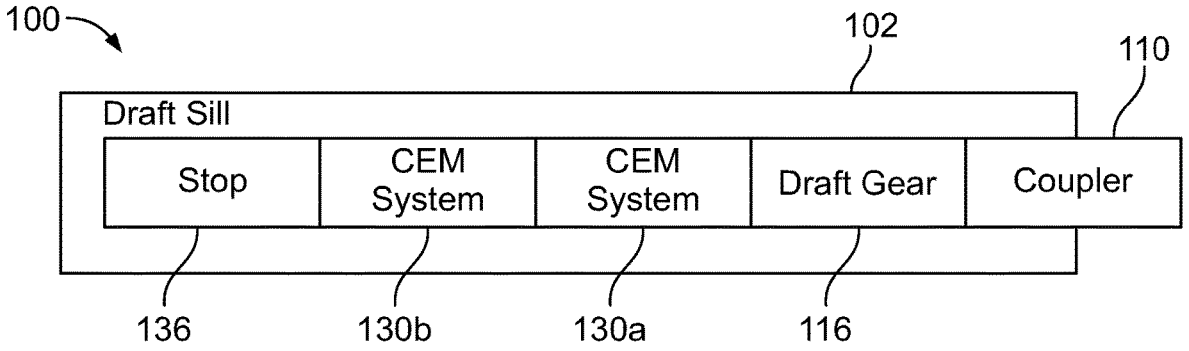
FIG. 15 illustrates a schematic block diagram of a car coupling system, according to an embodiment of the present disclosure.

FIG. 15 illustrates a schematic block diagram of a car coupling system 100, according to an embodiment of the present disclosure. As shown in FIG. 15, a first crash energy management system 130*a* is disposed aft of the draft gear 116, as described herein. A second crash energy management system 130*b* is disposed aft of the crash energy management system 130*b*. As such, the second crash energy management system 130*b* is disposed between the first crash energy management system 130*a* and the second stop 136. In this manner, the first and second crash energy management systems 130*a* and 130*b* are in series within the draft sill 102.

In at least one embodiment, the first crash energy management system 130*a* abuts directly into the second crash energy management system 130*b*. For example, referring to FIGS. 3-15, a first end plate 150 of the second crash energy management system 130*b* abuts directly against a second end plate 152 of the first crash energy management system 130*a*. The first end plate 150 of the second crash energy management system 130*b* may or may not be fastened to the second end plate 152 of the first crash energy management system 130*a*. In at least one other embodiment, the first energy management system 130*a* and the second energy management system 130*b* may be integrally molded and formed together. As an example, the second end plate 152 of the first crash energy management system 130*a* can be the first end plate 150 of the second crash energy management system 130*b*. That is, a common end plate may provide the second end plate 152 of the first crash energy management system 130*a* as well as the first end plate of the second crash energy management system 130*b*.

The first crash energy management system 130*a* may be configured the same as the second crash energy management system 130*b*. Optionally, the first crash energy management system 130*a* and the second crash energy management system 130*b* may differ in at least one respect (such as different length, diameter, wall thickness of respective central tubes 154, presence, locations, and/or number of supplemental tubes 170, and/or lengths, diameters, wall thickness thereof, and/or the like), as described herein.

As shown in FIG. 15, the car coupling system 100 includes two crash energy management systems 130*a* and 130*b*. Optionally, the car coupling system 100 can include three or more crash energy management systems 130, as desired.

In general, a single crash energy management system 130 may be effective up to a certain maximum stroke limit, beyond which capacity may be exceeded. If a longer stroke capacity is desired, multiple discrete crash energy management systems 130 (such as the first crash energy management system 130*a* and the second crash energy management system 130*b*) may be disposed within the draft sill 102 in series. Such a modular approach allows for additional stroke capacity, as desired. The force travel curve may have the same force values, just extended over longer distances.

Figure 16:
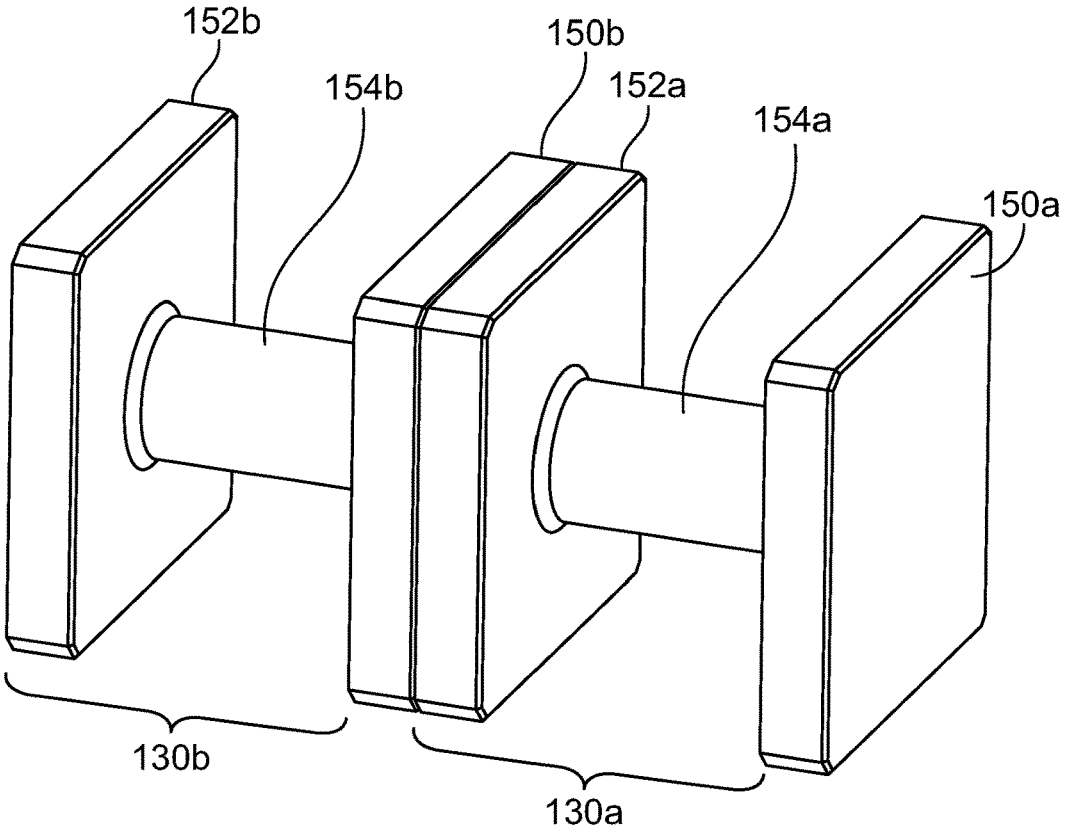
FIG. 16 illustrates a perspective view of a first crash energy management system coupled to a second crash energy management system, according to an embodiment of the present disclosure.

FIG. 16 illustrates a perspective view of the first crash energy management system 130*a* coupled to the second crash energy management system 130*b*, according to an embodiment of the present disclosure. As shown, the first end plate 150*b* of the second crash energy management system 130*b* abuts and directly connects to the second end plate 152*a* of the first crash energy management system 130*a*. The first end plate 150*b* and the second end plate 152*a* may or may not be secured together, such as with fasteners, adhesives, and/or the like.

The first end plate 150*b* of the second crash energy management system 130*b* may be considered a third end plate, so as to clearly distinguish from the first end plate 150*a* of the first crash energy management system 130*a*. Similarly, the second end plate 152*b* of the second crash energy management system 130*b* may be considered a fourth end plate, so as to clearly distinguish from the second end plate 152*a* of the first crash energy management system 130*a*. Further, the central tube 154*a* of the first crash energy management system 130*a* may be considered a first central tube, while the central tube 154*b* of the second crash energy management system 130*b* may be considered a second central tube.

In at least one embodiment, the first and second central tubes can be configured to act in unison, deforming at the same time once the initial predetermined force value is achieved. In this manner, the stroke of deformation can be achieved.

Figure 17:
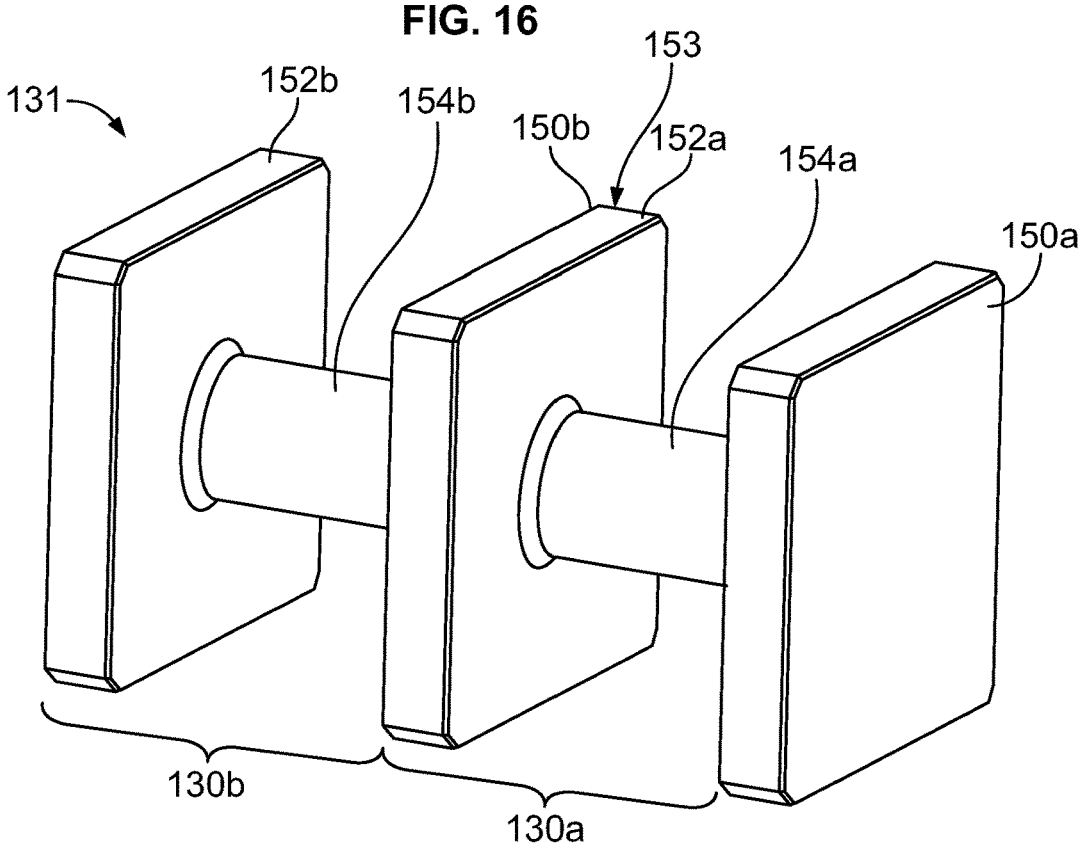
FIG. 17 illustrates a perspective view of a first crash energy management system coupled to a second crash energy management system, according to an embodiment of the present disclosure.

FIG. 17 illustrates a perspective view of a first crash energy management system 130*a* coupled to a second crash energy management system 130*b*, according to an embodiment of the present disclosure. As shown, the first crash energy management system 130*a* and the second crash energy management system 130*b* are integrally formed and molded as a single, monolithic structure. A common intermediate plate 153 provides the first end plate 150*b* of the second crash energy management system 130*b* and the second end plate 152*a* of the first crash energy management system 130*a*.

As shown in FIG. 17, an integral, tandem crash energy system 131 includes the first crash energy management system 130*a* and the second crash energy management system 130*b*. The crash energy management system 131 can be integrally molded and formed as a single, monolithic structure. In at least one other embodiment, the first end plate 150*b* can be separately and securely fixed to the second end plate 152*a*, such as through welding, fasteners, adhesives, and/or the like.

Referring to FIGS. 3-17, in at least one embodiment, the car coupling system 100 for a rail vehicle includes the draft sill 102. The first crash energy management system 130*a* is disposed within the draft sill 102. The first crash energy management system 130*a* includes the first end plate 150*a*, the second end plate 152*a*, and a first central tube 154*a* disposed between the first end plate 150*a* and the second end plate 152. The first central tube 154*a* is configured to deform in response to a first force exerted into the car coupling system 100 that exceeds a first predetermined force threshold. Deformation of the first central tube 154*a* attenuates at least a portion of the first force. A second crash energy management system 130*a* is disposed within the draft sill 102. The second crash energy management system 130*b* includes a third end plate (for example, the first end plate 150*b*), a fourth end plate (for example, the second end plate 152*b*), and a second central tube 154*b* disposed between the third end plate and the fourth end plate. The second central tube 154*b* is configured to deform in response to a second force exerted into the car coupling system 100 that exceeds a second predetermined force threshold. Deformation of the second central tube 154*b* attenuates at least a portion of the second force.

In at least one embodiment, the first force equals the second force, and the first predetermined force threshold equals the second predetermined force threshold. In at least one other embodiment, the first force differs from the second force, and the first predetermined forced threshold differs from the second predetermined force threshold.

In at least one embodiment, one or both of the first crash energy management system 130*a* or the second crash energy management system 130*b* is interchangeable with a third crash energy management system 130*n*. For example, the third crash energy management system 130*n* replaces one of the first or second crash energy management systems 130*a* or 130*b*. As another example, the third crash energy management system 130*n* replaces both the first and second crash energy systems 130*a* and 130*b*, such that the car coupling system 100 includes only one crash energy management system 130, namely the crash energy management system 130*n*.

Various materials can be used to form the crash energy management systems 130 depending on a desired force threshold upon which the crash energy management systems 130 are to deform. For example, the crash energy management systems 130 can be formed of steel, aluminum, or various other metals. Additionally, the crash energy management systems 130 can be sized and shaped for concertina buckling, as described herein, to provide an ideal energy attenuator. Moreover, a material having a particular yield strength, elongation characteristics, and/or the like can be chosen depending on the desired force threshold.

In at least one embodiment, mechanical properties such as yield strength, tensile strength, and elongation may be used to tune deformation of the crash energy management systems 130 (such as the main central tubes 154 and/or any supplemental tubes 170), as desired, such as to achieve specified trigger forces and curve quality. Further, in at least one embodiment, components of the crash energy management systems 130 (such as the main central tubes 154 and/or any supplemental tubes 170) can be pre-deformed, such as to provide stability and desired deformation triggering.

Certain embodiments of the present disclosure provide a method of forming a car coupling system for a rail vehicle. The method includes disposing a crash energy management system within a draft sill. The crash energy management system includes a first end plate, a second end plate, and a central tube disposed between the first end plate and the second end plate. The central tube is configured to deform in response to a force exerted into the car coupling system that exceeds a predetermined force threshold. Deformation of the central tube attenuates at least a portion of the force.

In at least one embodiment, the method further includes extending a coupler outwardly from a first end of the draft sill, disposing a first stop within the draft sill, disposing a draft gear having a yoke within the draft sill. connecting the coupler to the draft gear, and disposing a second stop within the draft sill, wherein the crash energy management system is disposed between the draft gear and the second stop.

As a further example, the method includes disposing a supplemental tube within an internal chamber of the central tube. As another or further example, the method includes disposing one or more supplemental tubes outside of the central tube.

Further, the disclosure comprises embodiments according to the following clauses:

Clause 1. A car coupling system for a rail vehicle, the car coupling system comprising:

- a draft sill;
- a first crash energy management system disposed within the draft sill, wherein the first crash energy management system comprises:
  - a first end plate;
  - a second end plate; and
  - a first central tube disposed between the first end plate and the second end plate,
  - wherein the first central tube is configured to deform in response to a first force exerted into the car coupling system that exceeds a first predetermined force threshold, and wherein deformation of the first central tube attenuates at least a portion of the first force; and
- a second crash energy management system disposed within the draft sill, wherein the second crash energy management system comprises:
  - a third end plate;
  - a fourth end plate; and
  - a second central tube disposed between the third end plate and the fourth end plate,
  - wherein the second central tube is configured to deform in response to a second force exerted into the car coupling system that exceeds a second predetermined force threshold, and wherein deformation of the second central tube attenuates at least a portion of the second force.

Clause 2. The car coupling system of Clause 1, wherein the first force equals the second force, and wherein the first predetermined force threshold equals the second predetermined force threshold.

Clause 3. The car coupling system of Clause 1, wherein the first force differs from the second force, and wherein the first predetermined forced threshold differs from the second predetermined force threshold.

Clause 4. The car coupling system of any of Clauses 1-3, wherein one or both of the first crash energy management system or the second crash energy management system is interchangeable with a third crash energy management system.

Clause 5. The car coupling system of any of Clauses 1, 2, or 4, wherein the first crash energy management system is configured the same as the second crash energy management system.

Clause 6. The car coupling system of any of Clauses 1, 3, or 4, wherein the first crash energy management system is configured differently than the second crash energy management system.

Clause 7. The car coupling system of any of Clauses 1, 3, 4, or 5, wherein the first central tube differs from the second central tube with respect to one or more of length, diameter, or wall thickness.

Clause 8. The car coupling system of any of Clauses 1-7, wherein one of the first crash energy management system or the second crash energy management system comprises one or more supplemental tubes.

Clause 9. The car coupling system of any of Clauses 1-8, wherein the first crash energy management system comprises one or more first supplemental tubes, and wherein the second crash energy system comprises one or more second supplemental tubes.

Clause 10. The car coupling system of Clause 9, wherein the one or more first supplemental tubes differ from the one or more second supplemental tubes with respect to one or more of length, diameter, or wall thickness.

Clause 11. The car coupling system of any of Clauses 1-10, wherein the third end plate directly abuts the second end plate.

Clause 12. The car coupling system of any of Clauses 1-10, wherein the second end plate and the third end plate are integrally formed together as a common intermediate plate.

Clause 13. The car coupling system of any of clauses 1-12, further comprising:

a coupler extending outwardly from a first end of the draft sill;

a first stop within the draft sill;

a draft gear having a yoke within the draft sill, wherein the coupler connects to the draft gear; and a second stop within the draft sill, wherein the first crash energy management system and the second crash energy management system are disposed between the draft gear and the second stop.

Clause 14. The car coupling system of any of Clauses 1-13, wherein each of the first central tube and the second central tube has a length, an outer diameter, and a wall thickness, wherein a ratio of the length to the outer diameter is 2:1, and wherein a ratio of the outer diameter to the wall thickness is 8:1.

Clause 15. A method of forming a car coupling system for a rail vehicle, the method comprising:

disposing a first crash energy management system within a draft sill, wherein the first crash energy management system comprises:

a first end plate;

a second end plate; and a first central tube disposed between the first end plate and the second end plate, wherein the first central tube is configured to deform in response to a first force exerted into the car coupling system that exceeds a first predetermined force threshold, and wherein deformation of the first central tube attenuates at least a portion of the first force; and disposing a second crash energy management system within the draft sill, wherein the second crash energy management system comprises:

a third end plate;

a fourth end plate; and a second central tube disposed between the third end plate and the fourth end plate, wherein the second central tube is configured to deform in response to a second force exerted into the car coupling system that exceeds a second predetermined force threshold, and wherein deformation of the second central tube attenuates at least a portion of the second force; and Clause 16. The method of Clause 15, further comprising interchanging one or both of the first crash energy management system or the second crash energy management system with a third crash energy management system.

Clause 17. The method of Clauses 15 or 16, further comprising configuring the first crash energy management system differently than the second crash energy management system.

Clause 18. The method of any of Clauses 15-17, further comprising directly connecting the third end plate directly with the second end plate.

Clauses 19. The method of any of Clauses 15-18, further comprising integrally forming the second end plate and the third end plate together as a common intermediate plate.

Clause 20. The method of any of Clauses 15-19, wherein each of the first central tube and the second central tube has a length, an outer diameter, and a wall thickness, wherein a ratio of the length to the outer diameter is 2:1, and wherein a ratio of the outer diameter to the wall thickness is 8:1.

As described herein, embodiments of the present disclosure provide systems and methods for attenuating energy exerted into a car coupling system. Further, embodiments of the present disclosure provide systems and methods that absorb energy that exceeds a predetermined force threshold. Moreover, embodiments of the present disclosure provide efficient, effective, and low cost systems for absorbing and attenuating such energy.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed:

1. A car coupling system for a rail vehicle, the car coupling system comprising:

a draft sill;

a coupler extending outwardly from a first end of the draft sill;

a first stop within the draft sill;

a draft gear having a yoke within the draft sill, wherein the coupler connects to the draft gear;

a second stop within the draft sill;

a first crash energy management system disposed between the draft gear and the second stop within the draft sill, wherein the first crash energy management system comprises:

a first end plate;

a second end plate; and a first central tube disposed between the first end plate and the second end plate, wherein the first central tube is configured to deform in response to a first force exerted into the car coupling system that exceeds a first predetermined force threshold, and wherein deformation of the first central tube attenuates at least a portion of the first force; and a second crash energy management system disposed between the draft gear and the second stop within the draft sill, wherein the second crash energy management system comprises:

a third end plate;

a fourth end plate; and a second central tube disposed between the third end plate and the fourth end plate, wherein the second central tube is configured to deform in response to a second force exerted into the car coupling system that exceeds a second predetermined force threshold, and wherein deformation of the second central tube attenuates at least a portion of the second force.

2. The car coupling system of claim 1, wherein the first force equals the second force, and wherein the first predetermined force threshold equals the second predetermined force threshold.

3. The car coupling system of claim 1, wherein the first force differs from the second force, and wherein the first predetermined forced threshold differs from the second predetermined force threshold.

4. The car coupling system of claim 1, wherein one or both of the first crash energy management system or the second crash energy management system is interchangeable with a third crash energy management system.

5. The car coupling system of claim 1, wherein the first crash energy management system is configured the same as the second crash energy management system.

6. The car coupling system of claim 1, wherein the first crash energy management system is configured differently than the second crash energy management system.

7. The car coupling system of claim 1, wherein the first central tube differs from the second central tube with respect to one or more of length, diameter, or wall thickness.

8. The car coupling system of claim 1, wherein one of the first crash energy management system or the second crash energy management system comprises one or more supplemental tubes.

9. The car coupling system of claim 1, wherein the first crash energy management system comprises one or more first supplemental tubes, and wherein the second crash energy system comprises one or more second supplemental tubes.

10. The car coupling system of claim 9, wherein the one or more first supplemental tubes differ from the one or more second supplemental tubes with respect to one or more of length, diameter, or wall thickness.

11. The car coupling system of claim 1, wherein the third end plate directly abuts the second end plate.

12. The car coupling system of claim 1, wherein the second end plate and the third end plate are integrally formed together as a common intermediate plate.

13. The car coupling system of claim 1, wherein each of the first central tube and the second central tube has a length, an outer diameter, and a wall thickness, wherein a ratio of the length to the outer diameter is 2:1, and wherein a ratio of the outer diameter to the wall thickness is 8:1.

14. A method of forming a car coupling system for a rail vehicle, the method comprising:

extending a coupler outwardly from a first end of a draft sill;

disposing a first stop within the draft sill;

disposing a draft gear having a yoke within the draft sill, wherein the coupler connects to the draft gear;

disposing a second stop within the draft sill;

disposing a first crash energy management system between the draft gear and the second stop within a draft sill, wherein the first crash energy management system comprises:

a first end plate;

a second end plate; and a first central tube disposed between the first end plate and the second end plate, wherein the first central tube is configured to deform in response to a first force exerted into the car coupling system that exceeds a first predetermined force threshold, and wherein deformation of the first central tube attenuates at least a portion of the first force; and disposing a second crash energy management system between the draft gear and the second stop within the draft sill, wherein the second crash energy management system comprises:

a third end plate;

a fourth end plate; and a second central tube disposed between the third end plate and the fourth end plate, wherein the second central tube is configured to deform in response to a second force exerted into the car coupling system that exceeds a second predetermined force threshold, and wherein deformation of the second central tube attenuates at least a portion of the second force.

15. The method of claim 14, further comprising interchanging one or both of the first crash energy management system or the second crash energy management system with a third crash energy management system.

16. The method of claim 14, further comprising configuring the first crash energy management system differently than the second crash energy management system.

17. The method of claim 14, further comprising directly connecting the third end plate directly with the second end plate.

18. The method of claim 14, further comprising integrally forming the second end plate and the third end plate together as a common intermediate plate.

19. The method of claim 14, wherein each of the first central tube and the second central tube has a length, an outer diameter, and a wall thickness, wherein a ratio of the length to the outer diameter is 2:1, and wherein a ratio of the outer diameter to the wall thickness is 8:1.

20. A car coupling system for a rail vehicle, the car coupling system comprising:

a draft sill;

a first stop within the draft sill;

a second stop within the draft sill;

a coupler extending outwardly from the draft sill;

a draft gear having a yoke within the draft sill, wherein the coupler connects to the draft gear;

a first crash energy management system disposed within the draft sill, wherein the first crash energy management system comprises:

a first end plate;

a second end plate; and a first central tube disposed between the first end plate and the second end plate;

and a second crash energy management system disposed within the draft sill, wherein the second crash energy management system comprises third and fourth plates:

a third end plate;

a fourth end plate; and a second central tube disposed between the third end plate and the fourth end plate wherein the first crash energy management system and the second crash energy management system are disposed between the draft gear and the second stop.

* * * * *